United States Patent [19]

Wainer et al.

[11] 4,187,105

[45] Feb. 5, 1980

[54] PHOTOSENSITIVE IMAGE FORMING COMPOSITION CONTAINING AT LEAST ONE SUBSTITUTED BIS-DIARYL VINYLIDENE COMPOUND AND/OR AT LEAST ONE SUBSTITUTED BIS-DIARYL IMINE COMPOUND

[75] Inventors: Eugene Wainer, Shaker Heights; James M. Lewis, Aurora, both of Ohio

[73] Assignee: Horizons Research Incorporated, Cleveland, Ohio

[21] Appl. No.: 908,668

[22] Filed: May 23, 1978

[51] Int. Cl.[2] ..... G03C 1/52; G03C 5/04; G03C 5/24

[52] U.S. Cl. ..... 430/336; 430/337; 430/344; 430/374; 430/432; 430/455; 430/510; 430/524; 430/533

[58] Field of Search ..... 96/48 R, 90 R, 90 PL, 96/67, 87 R, 27 E, 45.2

[56] References Cited

U.S. PATENT DOCUMENTS

| | | | |
|---|---|---|---|
| 3,501,301 | 3/1970 | Nadeau et al. | 96/87 R |
| 3,510,304 | 5/1970 | Fichter et al. | 96/48 R |
| 3,533,792 | 10/1970 | Petro et al. | 96/90 R |
| 3,573,911 | 4/1971 | Fotland | 96/90 R |
| 4,008,084 | 2/1977 | Ikeda et al. | 96/87 R |

*Primary Examiner*—Won H. Louie, Jr.
*Attorney, Agent, or Firm*—Lawrence I. Field

[57] ABSTRACT

A non-silver photosensitive image forming composition containing at least one substituted bis-diaryl vinylidene compound and/or at least one substituted bis-diaryl imine compound and tetraiodoethylene in a dried photosensitive layer thickness not exceeding 3 microns in layer thickness, the nature of the substitution being such that substantially any high extinction absorption peak or combination of high extinction absorption peaks is available from a family of compositions covering the range of 350 to 900 nm in wavelength, said composition being placed on a transparent or reflective substrate fitted with a compatible adhesive for the photosensitive layer not more than 0.5 micron in thickness and containing specialized stabilizers to permit precision information to be read out by a focused laser beam in either the transmissive or reflective mode, said precision information being placed on the film by exposure to precision light patterns followed by development and fixing with solvents and/or with heat not exceeding 115° C.

22 Claims, 5 Drawing Figures

Figure 1:
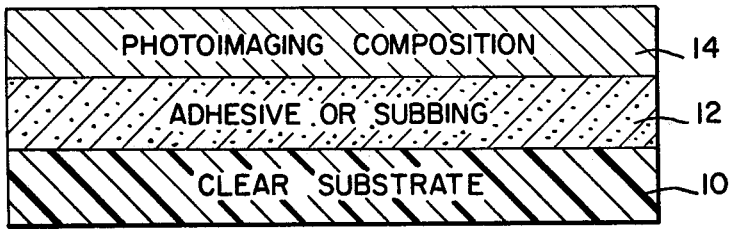

PHOTOSENSITIVE IMAGE FORMING COMPOSITION CONTAINING AT LEAST ONE SUBSTITUTED BIS-DIARYL VINYLIDENE COMPOUND AND/OR AT LEAST ONE SUBSTITUTED BIS-DIARYL IMINE COMPOUND

BACKGROUND OF THE INVENTION

Photochemical image forming reactions utilizing substituted bis-aryl ethylenic compounds have been described in the following U.S. Patents:

U.S. Pat. No. 3,510,304;
U.S. Pat. No. 3,533,792;
U.S. Pat. No. 3,573,911;
U.S. Pat. No. 3,764,334;
U.S. Pat. No. 3,769,023;
U.S. Pat. No. 3,986,880.

These utilize principally as the color formers, 1,1-bis-(p-dimethylaminophenyl)ethylene and its congeners. An exception is U.S. Pat. No. 3,573,911 in which the analog of the ethylene substituent is a thioketone whose proper chemical designation is 1,1-bis-(4-dimethylamino)thiobenzophenone. In all these patents, the principal free-radical activators used as a free-radical source are organic halogen compounds represented by the general formual A-C-$X_3$, wherein each X represents an iodine, bromine or chlorine atom and not all the X's need to be the same, and A represents a monovalent substituent taken from the group consisting of H, Cl, Br, I, alkyl, aryl, aroyl, and the like.

Of particular interest for the purposes of this presently disclosed invention is U.S. Pat. No. 3,533,792 in which the single dye former 1,1-bis-(p-dimethylaminophenyl)ethylene was used as the principal color former and in which specialized additives were made thereto so that an appropriate mixture of red, blue and green colors could be achieved by color coupling in the heat fixing step to yield an essentially black or near-neutral image specifically through the use of iodoform as the organic halogen compound acting as the source of free-radicals so that the described system could serve for photographic purposes.

The referred to patents define various additions for improvement of shelf life, increase in photographic speed, contrast and the like, through the use of such compounds as triphenylstibine, substituted phenols and cresols, N-oxides, bis-cyclic nitrogen compounds, high molecular weight alcohols, plasticizers, speed enhancers such as triphenylcarbinol and the like and mixtures thereof in order to yield practical systems of reasonable photographic speed, shelf stability, contrast and optical absorption suitable for practical purposes.

In addition, speed increases through use of optical development prior to heat fixing were described generally as a consequence of blanket exposure of the previously exposed system, in which the initial image-wise exposure was sufficient to produce either a barely visible or latent image and in which the wavelength of blanket exposure was equal to the spectral absorption peak of the barely visible or latent image produced as the result of the prior exposure, the two wavelengths being widely separated. Thus, ideally, the light amplifying step is most effective when the system is primarily U.V. sensitive and the principal light absorption peaks of the latent or near latent image produced in the image-wise expsoure resides at wavelengths at least 200 nm of longer wavelength than the long wavelength absorption edge of the moiety initially sensitive to the exposing light.

All of the compositional variations needed to produce the desired characteristics as defined in the patents indicated are applicable in the present invention.

While this broad base of activators and sensitizers can be used for stabilized image production in general, the use of iodoform of formula $CHI_3$ was found to be the most effective activator for the bis-aryl vinylidene systems, taking all aspects of practicality into consideration.

Thus, of particular background interest for the purposes of this invention with regard to the type of color formation which can be obtained as a consequence of exposure to light followed by heat fixing with or without an intervening optical development step for speed enhancement purposes, are the various patents in the foregoing list which emphasize iodoform in the examples as the principal activator.

In examining the various systems as disclosed by the prior art referred to using iodoform as the activator, practical experience has defined that the normal dry film photosensitive layer which is obtained and needed to achieve maximum density and appropriate keeping qualities falls in the range of 5 to 9 microns.

Certain applications for these types of image forming photosensitive layers involving readout of the optical information imposed on such films as derived by contact printing with a suitable master, defines that maximum resolution along with high edge acuity of image and with adequate optical density of image can be obtained only in photosensitive image producing layers which have a thickness of 3 microns or less. The 3 micron limitation is imposed by the limitations of the optics required for microscopic type of focused beam readout.

SUMMARY OF THE INVENTION

A non-silver photoimaging composition containing a mixture of tetraiodoethylene and substituted bis-aryl vinylidene compounds and/or substituted bis-aryl imine compounds of the following generalized formula:

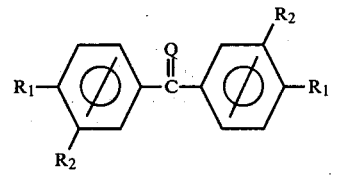

where Q represents either

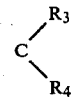

or N-$R_3$

A. where $R_1$ may be alkyl ($C_1$ to $C_4$), benzyl ($CH_2Ph$), $NH_2$, N dialkyl ($C_1$ to $C_4$), NH mono-alkyl ($C_1$ to $C_4$), NH mono-phenyl, hydroxy, alkoxy ($C_1$ to $C_4$), phenoxy, $RO_2CH$ where R=alkyl ($C_1$ to $C_4$), or $NHCO_2$ alkyl ($C_1$ to $C_4$) and $R_2$ is H and where the two $R_1$ groups may be either identical with each other or different, and where $C_1$ is methyl, $C_2$ is ethyl, $C_3$ is isopropyl and $C_4$ is t-butyl (thus excluding n-propyl and n-butyl).

B. where $R_1$ and $R_2$ may be any one of Group A and neither is H, either identical with each other or different.

C. where $R_1$ is H and $R_2$ may be $NZ_2$ where Z is H or alkyl ($C_1$ to $C_4$ as in A), H and alkyl ($C_1$ to $C_4$ as in A), or benzyl ($CH_2Ph$) and the two $R_2$ groups may be either identical with each other or different.

D. where $R_3$ and $R_4$ may be H, alkyl ($C_1$ to $C_4$ as in A), or phenyl, either identical with each other or different.

Photosensitive image forming layers of the above description, in dried film thickness not exceeding 3 microns, are placed on substantially optically clear substrates taken from the class of polyethyleneterephthalate, polycarbonate, polyphenyloxide or polymethylmethacrylate or on similar substrates which have been previously coated with a layer not more than 1000 A° in thickness of a highly reflective metal taken from the class of aluminum, chromium, gold, indium and alloys of indium or non-metals taken from the class of sulfur, selenium or tellurium alloyed with arsenic and a minor amount of bismuth or antimony.

Prior to placing the photosensitive layer on the substrates of the foregoing class whether optically transparent or opaque in view of the presence of reflective layer, the surface on which the image forming layer is placed is provided with an adhesive in dried thickness not greater than 0.5 micron comprised initially of 80 to 90% of an unsaturated polyester of the polyethyleneterephthalate class plus 10 to 20% of a crosslinking agent of the isocyanate class to which is added between 1 and 10% (based on the weight of the unsaturated polyester) of an alkyl amine, a phenylenediamine, or the bis-cyclic nitrogen compounds described in U.S. Pat. No. 3,764,334 and mixtures thereof.

The image forming layer is cast thereon from solution in the presence of a suitable polymer as the binding agent after the adhesive layer has been cured to permit the crosslinking to proceed to the thermosetting stage for the adhesive as completely as possible.

The desired absorption peaks for maximum efficiency of laser readout of the precise information available by imagewise exposure may be produced either by direct printout through exposure to a pattern of ultraviolet radiation of sufficient quantity followed by heating for fixing at a temperature not exceeding 115° C. or by a combination of heat and final fixing by a treatment with solvent.

When the direct printout mode is utilized usually exposures in the range of 100 to 500 mj are sufficient to yield the desired image density.

Alternately, the desired absorption peaks for maximum efficiency of laser readout of the precise information available by imagewise exposure to ultraviolet light may be produced by imagewise exposure of the photosensitive laser to a pattern of ultraviolet radiation in a range of 0.001 to 50 mj and the latent image thus produced is amplified after such imagewise exposure by blanket exposures with one or more wavelengths at least 200 nm longer than the long absorption wavelength of the image producing moiety while the photoimaging layer is maintained at a temperature between 25° C. and 60° C., and then may be fixed as before by heat not exceeding 115° C. or by a combination of heat and treatment with solvent.

Various additives for obtaining specific benefits are fully described in the prior art patents cited above with particular regard to stabilizers to permit storage of the compositions, to facilitate fixing of the compounds after exposure, and beneficial modifications for improving photographic speed and contrast. The present invention is applicable to compositions including one or more such additives.

The fully comprised photosensitive composition suitable for image forming purposes is placed in a solvent for all of the ingredients along with a polymeric binder and then cast on the adhesive fitted substrate of the types described above.

The invention will be better understood from the description which follows taken with the drawings in which:

FIGS. 1–5 are schematic plan views of photoimaging members prepared in accordance with the invention.

Figure 2:
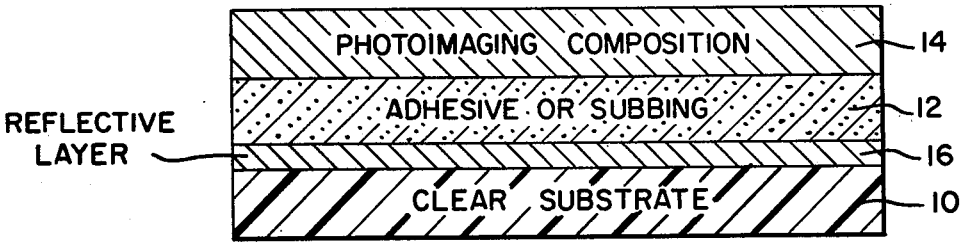

FIG. 1 illustrates a composite comprising a clear substrate of synthetic resin 10 on which there is a thin layer 12 of adhesive or subbing composition, which supports a film 14 deposited when the solvent is eliminated from a layer of photoimaging composition cast on the layer 12, as described in Examples 11 through 16 and elsewhere in the specification;

FIG. 2 is similar to FIG. 1 except that the substrate consists of layer 10 on top of which is placed a very thin film 16 of highly reflective material, e.g. as described in Example 17.

Figure 3:
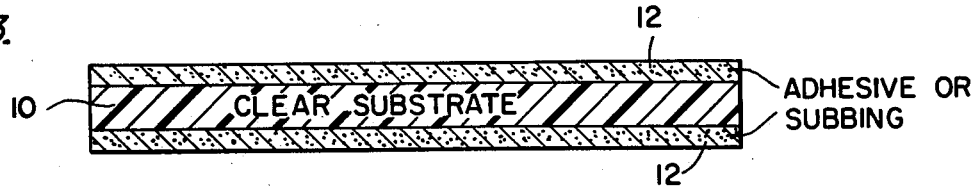

FIG. 3 is a view showing a substrate 10 coated with adhesive or subbing layer 12 on both faces thereof before the photoimaging layer 14 is cast thereon.

Figure 4:
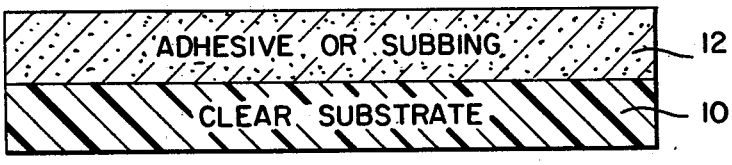
Figure 5:
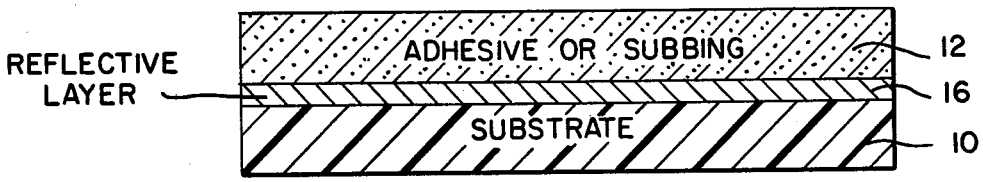

FIGS. 4 and 5 illustrates the composite of FIGS. 1 and 2 respectively before the photoimaging layer 14 is cast thereon as described in Examples 5 through 10.

DESCRIPTION OF THE INVENTION

Under the conditions defined in the above noted U.S. patents in which iodoform is the principal activator and 1,1-bis(4-dimethylaminophenyl)ethylene is the principal color former, the maximum optical density in the wavelength range of 600 to 850 nm obtained in a 4 micron thick layer was approximately 2.5 under the best conditions of stabilization and image enhancement without optical development irrespective of the length of exposure. The formula used for these evaluations and the comparative evaluations to follow is defined in Column 3 of U.S. Pat. No. 3,510,304. By increasing the film thickness, again using iodoform as the activator, a film thickness of 7 microns was required to achieve a maximum density at 600 to 850 nm of 3.5. However, if these films were stored in a sealed envelope at room temperature without special precaution for two to three weeks the maximum density achieved for the 4 micron coating was 1.7 and for the 7 micron coating again 3.5, very close to the value obtained for freshly made coatings.

All optical densities were read through an Eastman Kodak Red Filter #92 on a digital Macbeth TD 504 densitometer which measures optical densities to at least a level of 6.0 units of density with good accuracy in the wavelength range indicated. For wavelengths much above 850 nm, the light levels available from the densitometer are apparently too low to obtain accurate readings, in spite of the fact that the #92 filter will pass radiant energy at wavelengths considerably longer than 850 nm. Maximum optical density in each case was obtained by exposure to 500 mj of light available from a medium pressure Hg lamp, using an 11 step wedge in which the optical density was varied uniformly from zero units of optical density to 6.0 units of optical density. Base plus fog measurements were generally uniform at an optical density of 0.05 whereas measurements made on the 6.0 optical density step generally gave a value of 0.07 to 0.10 units of density.

Replacing all of the iodoform with tetraiodoethylene, the initial density achieved at 600 to 850 nm with a 4 micron thick coating immediately after preparation was 4.5 and for the 7 micron coating was 5.6. After two weeks storage under identical conditions as defined for the iodoform activated material, no change in optical density could be seen of measurable significance in both the 4 and 7 micron coatings. When the coating thickness was reduced to 3 microns or less optical densities in the 600 to 850 nm range (using the tetraiodoethylene formulation) in the range of 2.4 to 2.9 were achieved and this density was retained under the aforesaid storage conditions without measurable change. However, when iodoform was used as the sole activator, initial densities for photosensitive coating thicknesses of 3 microns or less were found to be in the rage of 1.0 to 1.4 and after two weeks storage under the conditions described previously, the optical density after heating for fixing dropped to less than half this value.

In reciting these data it is emphasized that when the dried coating thickness with iodoform is 6 microns and higher these density losses were not experienced, but the desired operative characteristics of the film with regard to resolution and acuity were not achievable with these relatively thick photo-imaging layers, when read out with a microscopically focussed beam of laser light.

If the thickness of the photosensitive imaging layer is successively reduced below 3 microns, the differences in optical density and retention of such optical density between that available between the use of tetraiodoethylene as the activator versus iodoform as the sole activator becomes greater and greater both on initial exposure irrespective of length and on storage.

The inference from these comparative data is that iodoform suffers from two defects with regard to the utilization of extremely thin photoimaging layers when compared with the use of tetraiodoethylene when this latter material is the free-radical source. The first defect is that iodoform in itself is less effective in achieving maximum density on fresh films, irrespective of thickness, than tetraiodoethylene. The second defect appears to lie in the fact that iodoform exhibits a significant vapor pressure at room temperature and thereby this all important ingredient is removed from the film by vaporization at a slow but significant rate. For most practical purposes, this loss of iodoform by vaporization from the film on storage prior to exposure is not important in photoimaging film thicknesses above 6 microns since an ample supply of the activator remains in the film for commercially useful lifetimes. This loss becomes especially important as the photoimaging layer thickness is successively reduced below 6 microns.

This manifestation is not experienced with tetraiodoethylene outside of its greater effectivness in producing maximum image density irrespective of photoimaging layer thickess. Tetraiodoethylene exhibits substantially zero vapor pressure at room temperature or orders of magnitude less than that exhibited by iodoform and thus the physical loss of the necessary activator from the system by vaporization on storage does not appear to occur or does not occur to anywhere near the extent as exhibited by iodoform.

In view of the greater emphasis on laser writing and laser readout for films exhibiting effectively ultimate optical resolution, and further in view of the extreme variety of lasers which can be used for this purpose and the extraordinary range of wavelengths which are available from one or another laser, in order for a photographic system of the appropriate resolution characteristics and stability to be effective, the photographic system must be capable not only of exhibiting specific absorptions in the image areas so as to obtain the maximum benefit from a specific laser but also means need to be defined for achieving black renditions in which the color former is obtained as a consequence of suitable mixtures of color active compounds, each of which achieve maximum density at equivalent photographic speeds. Thus, mixtures of family related compounds can be used such that a black rendition can be obtained in a manner different than that described in U.S. Pat. No. 3,533,792 where color differences including black are obtained through the use of color coupling reactions which are normally effective for coupling purposes only in the heating step and not as a direct result of the initial exposure. When the basic color formers are put together in suitable admixtures, the desired color rendition is available immediately on exposure which provides processing possibilities to ensure a much greater degree of dimensional stability than is available through the heat fixing steps defined in the prior art. The desired spectral absorptions are obtained by appropriate substitution in the aryl portions of the molecule, the vinylidene portions, or both.

Irrespective of the film base used on which the photosensitive imaging layer is placed, heating at temperatures much above 115° C. invariably produces a change in dimensions across the film of the order of 1% or greater. While this distortion can be eliminated by solvent fixing at room temperature, for practical purposes some fixing by heating is preferred. For film bases such as polyethyleneterephthalate, polycarbonate, polyphenelyene oxide, cellulose triacetate, and the like, effectively no dimensional change is seen in the heat fixing step providing the temperature of fixing is 115° C. or less for periods of 10 minutes or less for each of these and not more than 85° C. for polymethylmethacrylate.

This type of dimensional stability represents a requirement when the photographic image is used as the source of information readout by suitably constituted laser systems in that pieces of information not exceeding one square micron in size need to be located with duplicable facility and accuracy.

THE BINDER

As described in the previously cited patents, the photosensitive compositions are formulated with a film forming binder and are cast as a thin film from solution and dried. Among the binders which can be used for the purpose of this invention are solutions of polystyrene, copolymers of a styrene and acrylonitrile, polyphenylene oxide, polycarbonate, polyvinylbutryal, polymethylacrylate, suitable combinations of the above and others such as those described in the previously cited patents but also those from U.S. Pat. Nos. 3,100,703 and 3,147,117. The principal requirement of the binders utilized for the purposes of this invention other than lack of adverse reactivity is that they exhibit an optical density of not more than 0.05 units over a wavelength range of 350 nm to 900 nm. The binders noted above exhibit this property.

THE SUBSTRATES

Laser readout of photographic images can be accomplished both in transmissive and reflective modes.

When utilized in the transmissive mode, optical clarity over a wavelength range between 350 and 900 nm represents a requirement in that over this wavelength range the substrate should not exhibit an optical density of greater than 0.05 units of density. Optically clear substrates which fall in this category may be taken from the class of polyethyleneterephthalate, polycarbonate, polyphenyleneoxide, polymethylmethacrylate and cellulose triacetate.

These types of substrates which are suitable for the reflective laser readout mode are taken from the class of the optically clear polymer films listed in the previous category with the exception of polymethylmethacrylate, and in addition may be a polyimide, polyarylether, polyarylsulfone, polyethersulfones and polyphenylene sulfides.

An extremely thin layer of highly reflective metal taken from the class of aluminum, chromium, gold, indium and alloys of indium is deposited thereon usually in the range of 700 to 1200 A° thickness. These metal layers are generally applied by evaporation techniques from a pure metal source. Other types of reflective coatings which may be utilized for the reflective mode and also may be applied to the aforementioned substrates by evaporation are taken from the class of sulfur, selenium, tellurium and mixtures thereof, the sulfides, selenides and tellurides of arsenic and mixtures thereof and further in which the alloys of arsenic may be further complexed for reflective purposes over a broad range of wavelengths and particularly in the wavelength range of 600 to 900 nm by adding 5 to 15 mole percent of antimony or bismuth to these arsenic alloys.

In view of the requirement for extreme dimensional fidelity and also due to the nature of some of the solvents and polymers which may be utilized as essential parts of the photoimaging composition, several requirements are imposed on these substrates. These requirements include but are not necessarily limited to adhesion, elimination of swelling or other type of distortion of the substrate as a consequence of the solvents used for applying the photoimaging composition, lack of adverse chemical reaction between any one of the components of the photoimaging composition base and the like.

It has been found that of the aforementioned clear substrates which may or may not contain a reflective layer placed thereon that from a chemical or solvent swelling standpoint polyethyleneterephthalate usually exhibits poor adhesion between the photoimaging layer and the polyethyleneterephthalate base. While adhesion may be improved with the remaining list of substrates, these tend to react adversely either with the solvent used in the application of the photoimaging composition usually as a consequence of swelling and sometimes as a consequence of an adverse chemical reaction due to undesired mutual diffusion of a non-uniform nature of vital components of the photoimaging composition and the substrate so that an adverse separation of desired components takes place.

In the case of the clear films used for the transmissive mode, a very thin subbing layer is required. The principal component of this subbing layer is an unsaturated polyethyleneterephthalate which is thermoplastic when utilized in unmodified form and thermosetting when appropriately crosslinked. In the crosslinked and cured form, the material exhibits the optical properties and extreme chemical resistance normally exhibited by polyethyleneterephthalate itself.

The unsaturated polyester utilized for these purposes is manufactured by the duPont Company and is designated by the number 49,000. A crosslinking agent, also manufactured by the duPont Company, is a modified isocyanate designated by the number RC-805.

In its base form, one part of the unsaturated polyester No. 49,000 plus 0.1 to 0.2 parts of the modified isocyanate No. RC-805 is dissolved in 110 parts of solvent comprising a mixture of 3 parts by volume of ethylenedichloride and 1 part by volume of methylenechloride. After the wet solution is applied to the film and the solvent evaporated therefrom, the curing involving the formation of crosslinks to produce the chemically stable and inert adhesive material can be accomphished either by permitting the assembly to stand at room temperature for 1 to 3 weeks or may be accelerated down to a few minutes duration by heating in a temperature range between 90° and 160° C., depending on the thermal durability of the particular substrate which is being utilized.

While the base composition itself is generally effective for elimination of most of the adverse properties listed previously as a result of the application of the photoimaging layer, again dealing with the transparent mode, significantly improved results are obtained particularly with regard to stability and premature fogging by the addition of up to 10% of various amines such as triethylamine and orthophenylenediamine but most significantly the bis-cyclic nitrogen compounds described in U.S. Pat. No. 3,764,334, alone or in admixture with the aforecited amines to the subbing composition.

These modified subbing and adhesive layers of the type described in the previous paragraph are necessary for use when the photoimaging compositions of this invention are applied to the reflective surface with particular regard to the elimination of adverse chemical effects on storage and further to act as a positive aid in promoting adhesion between the photochemical imaging layer and the thin reflecting layer.

The major defect of substantially all of these reflecting layers from a chemical interference standpoint, with the exception of reflecting layers comprised of gold, is that a relatively rapid reaction takes place between the components, particularly the dye former, and the reflecting layer with the end result that the system starts to exhibit background fog on darkroom storage within a few hours after preparation and such background fog continues to build up on storage in 2 to 4 weeks to such an extent as to render the system useless for photoimaging purposes. This fogging defect is eliminated indefinitely by adding to the subbing layer colorless alkyl and aryl amines alone or in admixture with the bis-cyclic nitrogen compounds described in U.S. Pat. No. 3,764,334.

Application of the subbing layer to all of the transparent film bases listed previously as suitable for transmission purposes will in itself cause dimensional distortion of all of the transparent film bases listed with the exception of the polyethyleneterephthalate. This kind of distortion is eliminated for the remaining members of this group of optically transparent film bases by application of the subbing layer simultaneously to both sides of the film.

An unexpected benefit is achieved in the case of use of any one of these film bases which has been previously coated with the reflective layer. In this case, a one-sided subbing layer does not induce physical distortion of any one of the transparent film bases listed previously. This appears to be due to the protective effect of the reflective layer itself which prevents adverse diffusion of undesired chemicals from film base, solvent, and/or photoimaging layer. As a consequence one side coating on the reflective surface represents a satisfactory procedure.

THE COLOR FORMERS

The light produced color which may be obtained from the generalized composition is a function not only of the substituents on the aryl rings but also is a function of the nature of the substituents on the carbon atom which serves as the bonding linkage between the two aryl rings or congeners of such rings as described in the previously cited patents.

In order to establish the type of color which can be produced from these various color formers as a consequence of exposure to light in the presence of tetraiodoethylene, a model solution was utilized for this purpose. The first of these contained 10 mg of a particular color former, 10 mg of polystyrene, and 20 mg of tetraiodoethylene dissolved in 10 cc's of freshly distilled toluene under red light darkroom conditions. This solution was placed in a Pyrex test tube for subsequent evaluation.

After preparation in the darkroom as indicated above, the solutions were then exposed to an ultraviolet light source, specifically to a 275 watt G.E. RS sunlamp at a distance of 10" between the lamp and the Pyrex test tube containing the test solution. The principal wavelengths emitted from such a lamp of discrete nature are those of mercury with a rich content of radiation from 330 to 410 nm, equally strong radiation at approximately 436 to 577 nm. Radiation of lesser intensity is effectively broad band throughout the limits of the wavelength range indicated extending into the red and infrared.

On exposure of the systems described, color of varying intensities started to develop immediately with the color forming reaction appearing to be substantially complete in an exposure time of 3 to 10 seconds.

The nature of the colors formed with the base structure equivalent to a substituted bis-aryl vinylidene are shown as Example 1 in Table 1 in which the substituents are entirely in the 4 position on the phenyl ring, or the 3,4 position and to a lesser extent in the 3 position, again, as defined by the table. In examination of these data, colors from violet through red for each of the various substituents can be obtained by varying the nature and position of the substituents on the phenyl ring. Not only are these broad color variations available but the intensity of the color also varies as a function of the nature of the substituents. Again, as defined in the table, appropriate mixtures yield a neutral or black rendition.

The prior art cited in this specification lists temperature ranges of 120° C. to 160° C. and sometimes up to 190° C. for varying periods of time to ensure complete fixing of the image and background so no fog is seen on lengthy blanket exposure to actinic light (i.e. U.V.). In this specification a temperature limit of 115° C. for time periods not exceeding 10 minutes is imposed to ensure dimensional stability. More often than not this limit imposition is insufficient for complete fixing by heat alone and thus after the heat treatment, the residual photoactive ingredients must be removed by solvents. These solvents comprise a mixture of a major amount of hexane, petroleum ether, or Stoddards solvent with a minor amount of methyl alcohol, acetone, acetonitrile or nitromethane applied for immersion times in the range of 10 to 40 seconds.

EXAMPLE 1

TABLE 1

EFFECT OF ARYL SUBSTITUTION ON 1, 1-BIS(R-PHENYL)ETHYLENE
NOTE: 4 and 4' are bis-para; 3 and 3' are bis-meta on phenyl group

| $R_1$ = 4 and 4' (are the same) | COLOR |
|---|---|
| 1. Alkyl($C_1$ to $C_4$ | pale blue (cyan) |
| 2. N-alkyl($C_1$ to $C_4$) | intense blue |
| 3. $NH_2$ | medium blue-green |
| 4. OH | medium blue |
| 5. Alkoxy($C_1$ to $C_4$) | intense red |
| 6. Phenoxy | intense orange-red |
| 7. $NHCO_2$ alkyl ($C_1$ to $C_2$) | intense green |
| 8. $(Alkoxy)_2CH(C_1$ to $C_2)$ | intense green |
| $R_1$ = DIFFERENT 4 and 4' | |
| 9. 2 + 5 | intense violet |
| 10. 3 + 6 | intense magenta |
| 11. 5 + 8 | intense magenta |
| $R_2$ = 3 and 3' (are the same) | |
| 12. $NH_2$ | medium green |
| 13. N-alkyl($C_1$ to $C_2$) | intense blue-green |
| $R_2,R_1$ = 3,4 | |
| $R_2$ = 3,3', $R_1$ = 4,4' | |
| 14. methoxy($C_1$):N-dimethyl($C_1$) | intense green |
| 15. ethyl($C_2$):N-dimethyl($C_1$) | medium green |
| 16. N-dimethyl($C_1$):N-dimethyl($C_1$) | intense blue |
| 17. Phenoxy:Phenoxy | intense yellow |
| MIXTURES | |
| NEUTRAL-BLACK | |
| 18. 2 + 5 + 14 | |
| 19. 2 + 7 + 5 | |
| 20. 16 + 14 + 5 | |
| 21. 13 + 5 | |
| 22. 2 + 10 + 17 + 14 | |

EXAMPLE 2

Following the examination of the light induced color production effects of the series defined in Table 1, a second series was prepared to determine the nature of the color shifts which can be obtained in a homologous series in which the ethylenic substituent was replaced successively with propylenic and isobutylenic substituents. In this case the model compound used was 1,1-bis(4-dimethylaminophenyl)ethylene. In carrying out this work and referring to the summary given in the section entitled "Summary of the Invention," when $R_3$ and $R_4$ are both H(ethylenic), the color obtained is a deep blue as indicated in Table 1. When $R_3$ is H and $R_4$ is methyl(propylidene), the color obtained is a deep blue-green. When both $R_3$ and $R_4$ is methyl(isobutylidene), the color obtained was a deep green. When $R_3$ is methyl and $R_4$ is phenyl, the color is again a very deep green.

EXAMPLE 3

For a third series of color formers, when both $R_1$'s are methoxy, $R_3$ is H and $R_4$ is methyl, the color obtained is a deep red. In each case the color intensities are the speed with which the color developed were substantially equal.

In examining the spectral absorption available from these light modified solutions as measured on a spectrophotometer, it was found that all these derivatives exhibited at least three very strong absorption bands, among, others, in distinct regions. The first region extends from approximately 340 to approximately 410 nm, the second region from 600 to 700 nm and the third region from 800 to 900 nm. The actual absorption peak in each of these regions on substituting the original vinylidene group with the successively larger groups moves the absorption peaks within these three bands between 10 and 20 nm towards longer wavelengths as the size of the vinylidene group increases from that exhibited by the ethylenic group. Thus, while the absorption peak in the red and infrared was 655 nm and 830 nm for the ethylenic derivative, the comparable data for the propylenic derivative was 670 nm and 845 nm, and for the butylenic derivative 685 nm and 860 nm. Similar shifts were observed in the ultraviolet region.

A fourth series of color formers which might be considered in the same general category as the vinylidene group are those in which the ethylenic group is replaced with an imine group of the following formula:

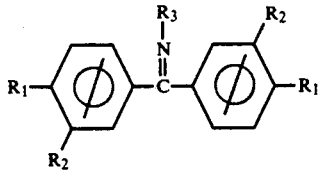

where the various R's have the indentities indicated for the general formula given in the section entitled "Summary of the Invention."

The principal effect of utilizing the imine group is to shift the visual color of the photoproduced product into the yellows, yellow-green, green-yellow and green. While the spectral absorption in the ultraviolet range defined previously for these types of compounds is increased markedly, the spectral absorption in the red and infrared bands defined previously is decreased and if the color produced has any significant amount of yellow which may be seen visually these red and infrared absorption peaks are practically eliminated.

EXAMPLE 4

A specific example is as follows: when both $R_{1's}$ are dialkylamino ($C_1$ to $C_4$) and $R_3$=H and there is no substitution in other portions of the molecule, this imine type of pseudo ethylenically unsaturated compound produces an intense yellow. When both $R_{1's}$ are NH alkyl ($C_1$ to $C_4$) and both $R_{2's}$ are alkyl ($C_1$ to $C_4$), the color produced is an intense green. Thus, it is seen that in this series that appropriate full substitution in both the $R_1$ and $R_2$ positions enables visual color shifts towards longer wavelengths to be obtained. If the single H in the imine group is replaced with an alkyl or a phenyl group, all other items being equal, similar shifts in the visual color towards longer wavelengths are also obtained.

Among the significant features of the color development results summarized thus far is that the speed of color production as a function of exposure to light appears to be substantially equivalent. As a consequence when appropriate mixtures of items in this group of color formers exhibiting high optical densities in the blue, green and red are used, a neutral black is obtained. Some examples of this type of rendition are given in Example 1, Table 1.

If, in addition, the color formers also show high optical densities in the U.V. band, the 600 to 700 nm band and the 800 to 900 nm band, as measured on a spectrophotometer, the color produced is a neutral "black" (i.e. substantially equal spectral absorption) over the entire wavelength band from 340 nm to 900 nm.

Once a suitable substrate for the image forming layer is defined, Table 2 represents a description of the range of compositions suitable for the purpose of this specification.

TABLE 2

PHOTOSENSITIVE COMPOSITION RANGES BASED ON THE AMOUNT OF TETRAIODOETHYLENE FIXED AT 200 MG

| | |
|---|---|
| Dry coating thickness | 1.0 to 3.0 microns |
| Toluene | 8 to 15 cc's |
| Polystyrene | 0.30 to 0.60 grams |
| Vinylidene and/or imine color former | 0.05 to 0.2 grams |
| Michler's Hydrol | 0 to 0.2 grams |
| 2,6-di-t-butyl cresol | 0.05 to 0.2 grams |
| 4-t-butyl catechol | 0 to 0.1 grams |
| Triphenyl carbinol | 0 to 0.1 grams |
| Triphenyl phosphate | 0 to 0.05 grams |
| Triphenyl stibine | 0 to 0.025 grams |
| 4-phenyl-pyridine-N-oxide | 0 to 0.05 grams |
| N-vinylcarbazole | 0 to 0.1 grams |
| Triethylamine | 0 to 0.1 grams |

The above represent composition ranges taken from the prior art cited on page 2 of this specification which have been found to be compatible with the teachings of the present specification with particular regard to the use of tetraiodoethylene as the activator (or free-radical source). Additions in the composition other than the basic constituents comprising the color former and the tetraiodoethylene serve the function of one or all of the properties of antifogging, speed enhancement, stabilization in processing and shelf life, and the like. These additives have relatively little effect on the direct print-out color obtained as heretofore described, but on heating after exposure to a noticeable print-out color, minor modifications of the exact color and density thereof are experienced, which do not have a basic effect on the teachings of this specification.

Having described the basic properties of this novel group of photoimaging materials designed to yield absorption peaks of intense nature for facilitation for precision readout by inexpensive lasers to the extremities of optical resolution, the following descriptions are further examples of our method of practice.

EXAMPLE 5(SUBSTRATES)

The following solution was prepared:
80 cc's ethylene dichloride;
30 cc's methylene chloride;
1 gram of duPont 49,000 unsaturated polyester;
0.2 grams of duPont RC-805 isocyanate;
0.1 grams of O-phenylene diamine.

A 2.5 thick layer of the above solution was spread on a 3 mil thick sheet of optically clear polyethylene terphthalate (duPont Type D Mylar) and the solvent eliminated by heating for 1 minute at 90° C. followed by post-cure for 10 minutes at 115° C. The thus coated sheet was then allowed to stand at room temperature for one week. The approximate thickness of the coating on the Mylar was 0.24 microns.

EXAMPLE 6(SUBSTRATE)

Same as Example 6, except that the O-phenylene diamine was replaced with 0.1 grams of 1,4-diazobicyclo-[2.2.2]octane.

EXAMPLE 7(SUBSTRATE)

Same as Example 5, except that the O-phenylene diamine was replaced with 0.05 grams of O-phenylene diamine and 0.05 grams of 1,4-diazobicyclo[2.2.2]octane. The thus coated sheet was then allowed to stand at room temperature for one week. The approximate thickness of the coating on the Mylar was 0.24 microns.

EXAMPLE 6(SUBSTRATE)

Same as Example 6, except that the O-phenylene diamine was replaced with 0.1 grams of 1,4-diazobicyclo-[2.2.2]octane.

EXAMPLE 7(SUBSTRATE)

Same as Example 5, except that the O-phenylene diamine was replaced with 0.05 grams of O-phenylene diamine and 0.05 grams of 1,4-diazobicyclo[2.2.2]octane.

EXAMPLE 8(SUBSTRATE)

A 1000 A° thick layer of aluminum was evaporated on one surface of a 3 mil thick sheet of polycarbonate film (Lexan, G.E.). Thereafter, the solution and process of Example 5 was applied to the aluminum surface.

EXAMPLE 9(SUBSTRATE)

Same as Example 8, except that the solution and process of Example 6 was applied to the aluminum surface.

EXAMPLE 10(SUBSTRATE)

A 1000 A° thick layer of an alloy consisting of 90 mole percent of $As_2Se_3$ and 10 mole percent Sb was evaporated on one surface of a 3 mil thick sheet of polysulfone. Thereafter, the solution and process of Example 5 was applied to the As-Se-Sb surface.

EXAMPLE 11(PHOTOIMAGING LAYER)

The following solution was prepared in a red light darkroom:

10.0 cc's toluene
0.45 grams polystryene (Lustrex, G.E.)
0.10 grams 1,1-bis(4-dimethylaminophenyl)ethylene
0.10 grams 2,6-di-t-butyl p-cresol
0.20 grams tetraiodoethylene Under red light darkroom conditions, a 25 micron thick layer of the above solution was spread on the adhesive side of the coated sheet as defined in Example 6 and the solvent eliminated by drying at 90° C. for 90 seconds. The photoimaging layer thickness is approximately 2 microns. Thereafter, the coated side was exposed to a calibrated U.V. light source (medium pressure Hg) through a step wedge for a time sufficient to yield 300 mj at the image plane. The specimen was heated for 10 minutes at 110° C. and all unreacted components removed by a 20 second rinse in a solvent comprised of 9 parts of hexane and 1 part of acetone, and then air dried. A deep blue image was obtained which exhibited a D-max. of 2.18 and a D-min. of 0.04 when read through an Eastman Kodak #92 red filter.

EXAMPLE 12

Same as Example 11, except 0.09 grams of 1,1-bis(4-methoxyphenyl)ethylene was substituted for the 1,1-bis(4-dimethylaminophenyl)ethylene and the coating was placed and treated as before on the adhesive side of Example 5. After exposure, heat treatment and fixing as defined in Example 11, a deep red image was obtained which exhibited a D-max. of 2.20 and a D-min. of 0.05 when read through an Eastman Kodak #94 blue filter.

EXAMPLE 13

Same as Example 11, except 0.11 grams of 1,1-bis(4-dimethylaminophenyl)isobutene was substituted for the 1,1-bis(4-dimethylaminophenyl)ethylene and the coating was placed and treated as before on the adhesive side of Example 3. After exposure, heat treatment and fixing as defined in Example 11, a deep green image was obtained which exhibited a D-max. of 2.19 and a D-min. of 0.04 when read through an Eastman Kodak #33 magenta filter.

EXAMPLE 14

The photosensitive solutions described in Examples 11, 12 and 13 were mixed and again coated and prepared as described previously on the adhesive side of the sheet as prepared in Example 7. After exposure, heating and fixing as described in Example 11, a deep black rendition was obtained where the black or neutral color was retained throughout the step wedge. The spectral absorption read without filters for D-max. and D-min. from 410 nm to 845 nm was a substantially uniform value of 2.1 and the D-min. was 0.05.

EXAMPLE 15

Traverses were made of Examples 11 through 14 maintaining the solvent and polymer amounts the same as follows:

Color formers—0.05 grams to 0.2 grams
2,6,-di-t-butyl-p-cresol—0.05 grams to 0.2 grams
Tetraiodoethylene—0.05 grams to 0.3 grams At the lower end of these ranges, the D-max. dropped from an average value of 2.19 to an average value of 1.4. At the upper end of these ranges the D-max. increased from an average value of 2.19 to an average value of 2.85 for Examples 11 through 13. In a similar traverse for Example 14, the lower concentration ranges produced a D-max. of 1.0 and the upper concentration ranges produced a D-max. of 2.4 in the 410 nm to 845 nm range.

EXAMPLE 16

The assembly of Example 11 was prepared in the red light darkroom as before and given an imagewise exposure of 1 mj to the U.V. light source. The specimen was placed on a circulating water heated platen at 60° C. and given a first blanket exposure of 2 joules at 655 nm followed by a second blanket exposure of 5 joules at 830 nm. After thermal and solvent processing as described in Example 11, the D-max. of the deep blue image was 2.65 and the D-min. 0.07 when read through an Eastman Kodak #92 filter.

EXAMPLE 17

A 1200 A° thick layer of Al was evaporated on one side of a 3 mil thich sheet of polycarbonate (Lexan, G.E.). The adhesive solution of Example 6 was applied to the Al layer and the assembly treated as defined in Example 5. No distortion of the assembly was observed, contrary to the extreme distortion observed when the Al layer was omitted.

In the darkroom, the composition and process of Example 11 was applied to the adhesive coated side. Again, the sheet remained flat and no distortion or dimensional change was observed over that exhibited by the sheet described in the previous paragraph. Only the 300 mj exposure portions were used for subsequent measurements.

The difference in light absorption and reflection was measured with a reflection densitometer with a scale of 0 to 100 units using a He-Ne 20 mw laser emitting a wavelength of 632.8 nm as the light source. The non-image areas reflected 90% of the incident light and the image portions approximately 1% of the incident light. All measurements were made at normal incidence.

A 1000 A° layer of gold reflected 95% of the incident light and a similar thickness of chromium 91% of the incident light in the non-image portions while in both cases, again, approximately 1% of the incident light was reflected from the image portions.

We claim:

1. In a non-silver photoimaging composition which includes at least one organic halogen compound and at least one colorless bis-aryl compound selected from the group consisting of substituted bis-aryl vinylidene compounds, substituted bis-aryl imine compounds and mixtures thereof, and wherein an image is produced as a result of the imagewise exposure of said composition to a pattern of radiation which causes said organic halogen compound to generate free radicals, the improvement which comprises providing tetraiodoethylene as an organic halogen compound present in said composition to activate the formation of a colored image therein from the colorless bis-aryl compound.

2. A photoimaging laminate element comprising the following lamina:

(1) a clear transparent substrate;
(2) a stabilized transparent adhesive layer on one surface of said substrate; and
(3) a layer comprising a non-silver photosensitive composition according to claim 1 adhered to said substrate by means of said stabilized adhesive.

3. A photoimaging laminate element comprising the following lamina:

(1) a clear transparent substrate;
(2) a stabilized adhesive layer on both surfaces of said substrate; and
(3) a layer comprising a non-silver photosensitive composition according to claim 1 adhered to said substrate by means of said stabilized adhesive and applied to at least one of the stabilized adhesive layers.

4. A photoimaging laminate element according to claims 2 or 3 wherein said clear transparent substrate is a material selected from the group consisting of polyethylene terephthalate, polycarbonate, polyphenylene oxide, polymethylmethacrylate, and cellulose triacetate.

5. A photoimaging laminate element comprising the following lamina:

(1) a thin film substrate;
(2) a thin reflecting film on one surface of said substrate;
(3) a stabilized adhesive layer applied to the reflecting film surface; and
(4) a layer comprising a non-silver photosensitive composition according to claim 1 adhered to said reflecting film by means of said stabilized adhesive.

6. A photoimaging laminate element according to claim 5 wherein said thin film substrate is a material selected from the group consisting of polyethylene terephthalate, polycarbonate, polyphenylene oxide, polyimide, polyarylether, polyarylsulfone, polyethersulphones, and polyphenylene sulfide.

7. A photoimaging laminate element according to claim 2, 3, 4 or 5, in which said stabilized adhesive layer comprises a thermoset cross-linked polyethylene terephthalate made from the reaction between a major amount of thermoplastic unsaturated polyethylene terephthalate (designated as duPont 49000) and a minor amount of isocyanate cross-linking agent designated as duPont RC-805) plus a minor amount of at least one organic alkaline compound taken from the group consisting of alkyl amines, aryl amines and bis-cyclic nitrogen compounds.

8. A photoimaging laminate element according to claim 5 where the thin reflecting film is comprised of at least one of the materials selected from the group consisting of metals comprising aluminum, chromium, gold, indium, and alloys of indium; non-metals comprising sulfur, selenium and tellurium and mixtures thereof; and non-metallic compounds comprising sulfides, selenides or tellurides of arsenic and mixtures thereof with or without the addition of minor amounts of antimony or bismuth.

9. The photoimaging laminate of any of claims 2 through 8 wherein said photosensitive composition is a layer having a thickness up to 3 microns.

10. A photoimaging element according to any of claims 1 through 9 in which the photosensitive layer comprises a binder wherein there are present:

(1) at least one bis-aryl color forming compound; and
(2) tetraiodoethylene.

11. The photosensitive layer of claim 1 wherein the vinylidene and imino compounds are compounds represented by the generic formula

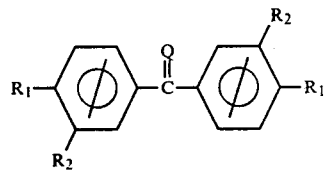

where Q represents either

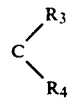

or N—$R_3$

A. where $R_1$ represents alkyl ($C_1$ to $C_4$), benzyl ($CH_2Ph$), $NH_2$, N dialkyl ($C_1$ to $C_4$), NH mono-alkyl ($C_1$ to $C_4$), NH mono-phenyl, hydroxy, alkoxy ($C_1$ to $C_4$), phenoxy, $RO_2CH$ where R=alkyl ($C_1$ to $C_4$), or $NHCO_2$ alkyl ($C_1$ to $C_4$) and $R_2$ is H and where the two $R_1$ groups may be either identical with each other or different, and where $C_1$ is methyl, $C_2$ is ethyl, $C_3$ is isopropyl and $C_4$ is t-butyl;

B. where $R_1$ and $R_2$ each represent any one of Group A and neither is H, and $R_1$ and $R_2$ are either identical with each other or different;

C. where $R_1$ is H and $R_2$ represents $NZ_2$ where Z is H or alkyl ($C_1$ to $C_4$ as in A), H and alkyl ($C_1$ to $C_4$ as in A), or benzyl ($CH_2Ph$) and the two $R_2$ groups may be either identical with each other or different; and D. where $R_3$ and $R_4$ each represent H, alkyl ($C_1$ to $C_4$ as in A), or phenyl, and $R_3$ and $R_4$ are either identical with each other or different.

12. The photosensitive layer of any of claims 10 through 11 wherein the color former is 1,1-bis(4-dimethylaminophenyl)ethylene.

13. The photosensitive layer of any of claims 10 through 11 wherein the color former is 1,1-bis(4-methoxyphenyl)ethylene.

14. The photosensitive layer of any of claims 10 through 11 wherein the color former is 1,1-bis(4-dimethylaminophenyl)isobutene.

15. The photosensitive layer of any of claims 10 through 11 wherein the color formers are an equimolecular mixture of 1,1-bis(4-dimethylaminophenyl-)ethylene, 1,1-bis(4-methoxyphenyl)ethylene and 1,1-bis(4-dimethylaminophenyl)isobutene.

16. The photosensitive layer of any of claims 10 through 11 wherein the color former is 1,1-bis(4-dimethylaminophenyl)imine.

17. The photosensitive layer of claim 10 wherein the layer contains at least one additional constituent selected from the group consisting of Michler's hydrol, triphenyl carbinol, triphenyl phosphate, 4-phenyl-pyridine-N-oxide, and N-vinylcarbazole as speed enhancers and contrast modifiers.

18. The photosensitive layer of claim 10 wherein the layer contains at least one shelf life stabilizer selected from the group consisting of 2,6-di-t-butyl cresol and 4-t-butyl catechol.

19. The photosensitive layer of claim 10 wherein the layer contains at least one anti-foggant selected from the group consisting of triphenyl stibine and triethylamine for prevention of premature fogging in processing after exposure in which such processing includes the use of heat and/or elevated temperatures.

20. The photosensitive layer of claim 10 wherein the layer contains at least one constituent each taken from the groups defined in claims 17, 18 or 19 to yield the combined desired functions of speed enhancement, contrast modifications, shelf life stabilization and prevention of premature fogging during heat fixing steps in a single photosensitive layer.

21. The process of producing an image from the photo-sensitive composition of any of claims 10 through 20 comprising the following steps:

(1) exposing said composition to a pattern of ultraviolet radiation in an amount up to 500 mj to produce an image in said composition;

(2) heating said composition after said exposure for a period of time up to 10 minutes in a temperature range of 85° C. to 115° C. to at least partially fix the image in said composition;

(3) completing fixing of the image in said composition by solvent extraction with a mixture comprising a major amount of non-polar straight chain hydrocarbon and a minor amount of a polar solvent selected from the group consisting of methyl alcohol, acetone, acetronitrile and nitromethane for extraction times of 10 to 40 seconds; and (4) thereafter drying said composition for removal of said mixture.

22. The process of producing an image from the photo-sensitive composition of any of claims 12 through 16 and claim 20 comprising the following steps:

(1) exposing said composition to a pattern of ultraviolet radiation of up to 50 mj to produce an image in said composition;

(2) blanket exposing the resulting exposed composition while holding said composition at a temperature up to 60° C. with, first, up to 2 joules at 655 nm followed by, second, up to 5 joules at 830 nm;

(3) heating said composition after the exposures in (2) for a period of time up to 10 minutes in a temperature range of 85° C. to 115° C.; and (4) thereafter completing the fixing of the image in said composition by solvent extraction; and (5) thereafter drying said composition for removal of solvent remaining from said solvent extraction step.

* * * * *